United States Patent [19]

Wiberg, deceased et al.

[11] 4,194,299

[45] Mar. 25, 1980

[54] CONDENSATE DISCHARGING DEVICE

[75] Inventors: Karl V. Wiberg, deceased, late of Sundsvall, Sweden; Anna-Britta Wiberg, legal representative, Goteborg, Sweden

[73] Assignee: SCA Development Aktiebolag, Sweden

[21] Appl. No.: 895,353

[22] Filed: Apr. 11, 1978

[51] Int. Cl.[2] ..... F28F 5/02

[52] U.S. Cl. ..... 34/124; 34/119; 165/90

[58] Field of Search ..... 34/119, 124, 125, 159, 34/161; 165/89, 90

[56] References Cited

U.S. PATENT DOCUMENTS

| | | | |
|---|---|---|---|
| 1,643,973 | 10/1927 | Woodsome | 34/124 |
| 2,102,106 | 12/1937 | Allen | 34/124 |
| 2,561,874 | 7/1951 | Lahman | 34/119 |
| 2,869,248 | 1/1959 | Justus | 34/124 |
| 3,481,050 | 12/1969 | Cox, Jr. | 34/124 |
| 4,077,466 | 3/1978 | Fleissner | 34/124 |
| 4,106,211 | 8/1978 | Holik | 34/124 |

*Primary Examiner*—Larry I. Schwartz

*Attorney, Agent, or Firm*—Lerner, David, Littenberg & Samuel

[57] ABSTRACT

Apparatus for drying web materials is disclosed, including a drum, means for supplying steam under pressure to the interior of the drum, passage means extending axially in a portion of the outer drum wall and through one of its end walls for removing condensed steam formed within the drum therefrom, groove means extending circumferentially around the inner surface of the cylindrical drum for collecting condensed steam and supplying it to the passage means, throttle means outside of the end wall, vacuum condensing means under reduced pressures for condensing steam carried by the condensate, and discharge conduit means connecting the throttle means to the vacuum condensing means, the throttle means being adapted to provide a pressure drop between the passage means and the discharge conduit.

6 Claims, 3 Drawing Figures

CONDENSATE DISCHARGING DEVICE

FIELD OF THE INVENTION

The present invention relates to cylinders for drying web materials, and in particular to such cylinders for use in the drying section of a papermaking machine.

BACKGROUND OF THE INVENTION

In conventional cylindrical drying apparatus the jacket of the drying cylinder is generally heated by steam which is supplied under pressure to the interior of the cylinder. Heating is thus effected such that the steam condenses in the cylinder and thereby emits heat therein. After the steam has condensed, however, the condensate must be removed from the cylinder. It is thus desirable that as much steam as possible be condensed in the cylinder in connection with such heating apparatus. This therefore implies that the amount of steam removed from the cylinder along with the condensate be minimized.

Because of the centrifugal force produced by rotation of the drying cylinder, the condensate is collected along the inner surface of the cylinder. In order to discharge the condensate from the cylinder, a pipe such as a siphon pipe is usually arranged radially within the cylinder. The siphon pipe thus communicates with a collecting pipe which is generally provided centrally within the cylinder and which sealingly extends out of the cylinder to a collecting vessel. The condensate is thus discharged by means of a pressure difference maintained between the steam space within the cylinder and this collecting vessel.

Such siphon pipes have thus either been stationary, i.e. non-rotary with the cylinder, or may rotate with the cylinder by being clamped therein. In the former case the medium flowing within the radial pipe would not be effected by any centrifugal force. By thus designing the end of the siphon pipe in a suitable manner, the kinetic energy of the rotating condensate at the stationary end point of the siphon pipe can be utilized for discharging the condensate. This type of design, however, has proved much less suitable in connection with high speed drying machines.

The siphon pipe is thus most usually designed to rotate with the cylinder, and in that case the resistance arising in transporting the medium through the radially extending pipe against the centrifugal force therein must be taken into consideration. The siphon pipe thus employed at present is normally designed in order to render this pressure resistance as low as possible. This may be accomplished by admixing from about 10 to 25% of steam with the condensate so that the two-phase medium including steam and water has a much lower density than if the medium consisted of the water alone. Such a solution is, however, disadvantageous in that a great amount of overflowing steam must then be separated for re-use. The latter is accomplished in so-called cascade systems employing a plurality of successively decreasing groups of condensers connected in series until a small residual amount of steam (i.e. between about 1 and 5%) is condensed in a particular condenser. It is also inherent in the function of such cascade systems that the flows and pressures are tied to correct flow of steam and condensate as well as steam pressures and temperatures, which are not always adapted to drying processes in such drying machines.

The use of such siphon pipes, however, involves several disadvantages. It is difficult to obtain sufficient structural strength therein, and furthermore the location of the pipe within the cylinder renders access to the siphon pipe for purposes of cleaning extremely difficult. One such system which employs such siphon pipes is shown in Swedish Pat. No. 74255.

Another method for removing condensate from such rotating vessels is shown in British Pat. No. 956,588. That patent employs a rotating vessel which has an internal surface which has an increasing diameter as one moves from the center of the vessel to its ends. In this manner liquid within the vessel is caused to flow outwardly to its ends, and means are thus provided for discharging same. In particular, however, in FIG. 5 of this British patent, a device used in connection with the internal shape of the drum is shown including nozzles around the ends of the drum cooperating with a stationary annular duct coaxial with the drum and having a continuous opening facing the drum to receive liquid emitted from the nozzles. In particular, the nozzle bores are preferably reduced towards their outer end to maintain a pressure differential between the interior and exterior of the drum. Apart from the required unique shape of the drum employed in connection with this patent, it further does not overcome prior difficulties such as difficulties in cleaning the apparatus, and further difficulties are raised by this apparatus, including the annular duct for condensate collection, and the fact that it is open to the atmosphere.

SUMMARY OF THE INVENTION

In accordance with the present invention it has now been discovered that these and other difficulties can be overcome by providing a cylindrical drum including a tubular jacket and a pair of end walls, means for supplying steam under pressure to the interior of said drum, condensate removal means for removing condensed steam formed within said drum, said condensate removal means comprising passage means extending axially within a portion of said tubular jacket and through one of said end walls, condensate collection means communicating with said passage means, said condensate collection means comprising groove means extending circumferentially about the inner surface of said tubular jacket for collecting said condensed steam formed within said drum and supplying said condensed steam to said passage means, throttle means communicating with said passage means exterior to said end wall, vacuum condensing means for condensing steam carried by said condensate, said condensing being carried out under reduced pressure, and discharge conduit means connecting said throttle means to said vacuum condensing means, said throttle means being adapted to provide a pressure drop between said passage means and said discharge conduit so that the amount of steam carried by said condensate is limited to an amount of less than about 5 weight percent.

In a preferred embodiment, the discharge conduit means includes a condensate removal conduit coaxial with said cylindrical drum and radial discharge conduit means communicating with said throttle means and said condensate removal conduit. It is thus preferred that the radial discharge conduit be in communication with the condensate removal conduit by means of an annular coupling so that the radial discharge conduit can rotate about the condensate removal conduit with the rotation of the cylindrical drum.

In a preferred embodiment of the present invention the passage means will have a diameter of between about 5 and 15 millimeters, and the throttle means will have a diameter between about 2 and 5 millimeters.

DETAILED DESCRIPTION

Figure 1:
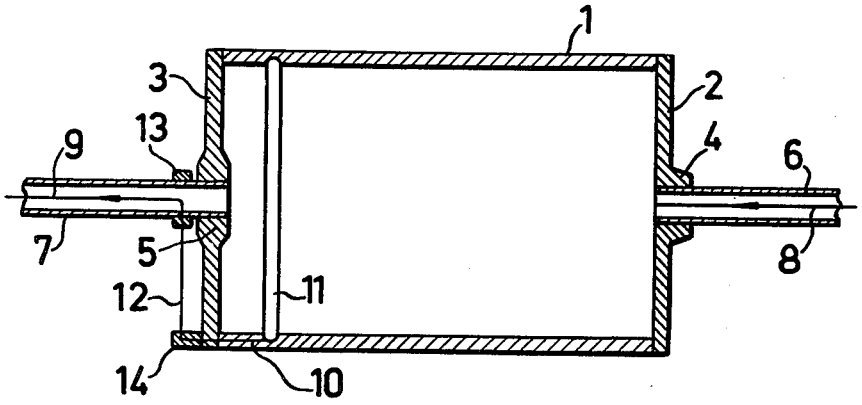
FIG. 1 is a side cross-sectional view of a drying cylinder in accordance with the present invention.
Figure 2:
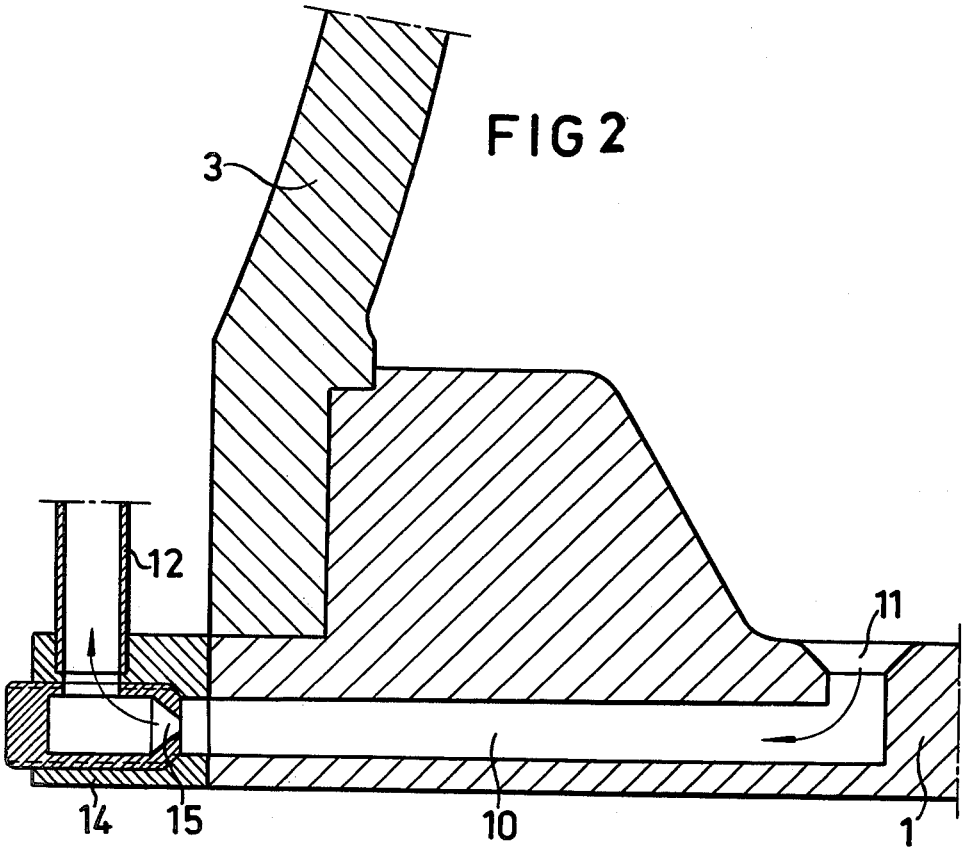
FIG. 2 is a partial sectional side view of a portion of the passage means and throttle means for condensate discharge in accordance with the present invention.
Figure 3:
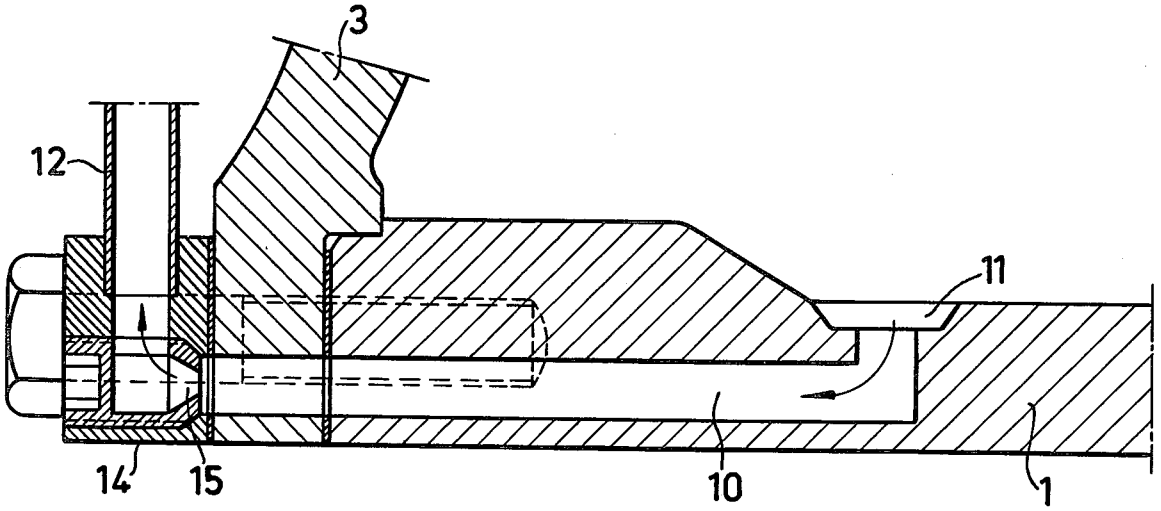
FIG. 3 is a partial sectional side view of another embodiment of a portion of the passage means and throttle means for condensate discharge in accordance with the present invention.

The drying cylinder of the present invention is thus formed with a passageway which extends from a point within the inner surface of the cylinder through the cylindrical jacket of the cylinder and the cylinder end wall. From this point a conduit extends inwardly in a radial manner to the axle about which the cylinder rotates, and further to a condensate collecting vessel where the condensate is separated, and the collecting vessel is evacuated to a vacuum condenser by means of a control valve. Throttle means is connected in this passageway and is accessible from the outside of the apparatus. By employing such a throttle means a relatively high pressure drop is established, and depends upon the circumferential speed of the cylinder (i.e. the machine speed) and which is independent on the cylinder radius. Thus, the case of water or condensate alone (having a density of 1000 kg/m$^3$) the calculated pressure difference required would be 1.2 atmospheres at a speed of 900 meters/minute; 0.5 atmospheres at 600 meters/minute; and 0.3 atmospheres at 400 meters/minute. In the case of condensate discharge alone through the throttle means, steam in equilibrium with the condensate within the cylinder thus results in a pressure drop in the condensate which corresponds to the pressure difference established by the throttle means. The boiling point of the condensate is thus lowered, i.e. the condensate boils and additional steam is formed, so that a two-phase medium is formed in the condensate after it leaves the throttle means. Since the resistance in the conduit depends on the density of the medium passing therethrough, and further since the volumetric weight of the two-phase medium containing some percentage of steam is substantially reduced (i.e. to about 25–100 kg/m$^3$) as compared to that of water alone (about 1000 kg/m$^3$), the pressure difference required over the throttle means accordingly decreases. By nevertheless maintaining a suitably high pressure difference in the throttle means, i.e. exceeding that calculated to be required therein, discharge of the condensate with a small amount of steam from the interior of the drum is obtained. The amount of overflowing steam must, however, be smaller than if steam alone were to flow through the throttle means to produce the same pressure difference. At steam pressures which usually prevail in such drying cylinders, i.e. less than about 10 atmospheres absolute pressure, and usually less than about 3 atmospheres absolute pressure, the relationship between the amounts of steam alone to that of water alone is the square root of the relation between the density of the respective media. Thus, at a steam pressure of about 1 atmosphere absolute pressure the ratio steam/water equals 0.024; and a steam pressure of about 3 atmospheres absolute pressure the ratio steam/water equals 0.042; and at a steam pressure of about 10 atmospheres absolute pressure the ratio steam/water equals 0.076, i.e. thus steam alone would be from about 2.4 to 7.6 percent of water alone. The amount of overflowing steam is thus smaller than this amount and can be varied by adjusting the pressure difference over the throttle means.

Thus, in accordance with the present invention the amount of steam removed from the overall system by means of a separator and a control valve to the vacuum condenser consists of both overflow steam and steam expanded out of the condensate after it leaves the throttle means, and together will be less than about 5% of the amount of separated condensate, generally between about 2 and 5% thereof. The amount of overflow steam is thus restricted by the opening in the throttle means and by the pressure difference thereover. The size of this opening is determined by the maximum amount of condensate formed, possibly with a small margin being allowed for accumulated condensate.

For example, at a machine speed of about 900 meters/minute a pressure difference over the throttle means of about 1.2 atmospheres would be required for discharging undercooled condensate, and of about 0.7 atmospheres for discharging condensate in equilibrium with the pressurized steam in the cylinder. This data can be utilized such that for normal operations the pressure difference of 0.7 atmospheres can be utilized, and when abnormally undercooled condensate (i.e. uncondensable gas in the cylinder) is being formed the pressure difference can be raised to 1.2 atmospheres for short periods. With about 0.2 atmospheres absolute pressure in the vacuum condenser, a steam pressure of about 1.4 atmospheres absolute pressure would be rquired in the cylinder in order to obtain a pressure difference of about 1.2 atmospheres. The steam pressure in the cylinder as well as the pressure difference are restored to normal values when the drying effect is again obtained, i.e. when uncondensable gas has been evacuated from the cylinder into the vacuum condenser.

By designing the drying cylinders in this manner an arbitrary number of groups of drying machines can be assembled and each group fed with steam to the correct drying temperature (i.e. steam pressure) irrespective of the other groups, and the amount of steam produced in the expanding condensate as well as possible overflow steam removed from the cylinder can be separated from the condensate in the collectingl separator and the steam drawn off to the condenser through the control valve for the particular pressure difference over the throttle means.

Having thus described the present invention, it will be more fully understood with reference to the figures, in which correspondingl reference numerals refer to corresponding portions thereof. Referring specifically to FIG. 1, the drying cylinder consists of a jacket 1 and a pair of end walls 2 and 3 including hub portions 4 and 5. The cylinder is supported by two axle journals 6 and 7 fitted into hubs 4 and 5. In axle journal 6 a conduit 8 is provided for supplying steam to the interior of the cylinder. In the second axle journal 7 a conduit 9 is provided for discharging condensate from the drying cylinder. Conduit 9 thus communicates with a vacuum condenser, not shown in the drawing.

The cylindrical jacket 1 has a substantially smooth inner surface and is provided with at least one passageway 10 located on the discharge side of the cylinder near end wall 3. The passageway 10 communicates with the interior of the cylinder by providing the inner jacket surface at the opening of the passageway 10 with a groove 11 extending circumferentially about that inner surface for collecting condensate. A number of passageways 10, preferably from about 2 to 4 such passageways, can also be arranged about the cylinder. The passageway 10 communicates with discharge conduit 9 in axle journal 7 through a conduit 12 and a coupling 13. At the opening of the passageway 10 in the end wall 3 a connecting part 14 is provided in order to couple together passageway 10 with conduit 12. In this connecting part 14 is inserted throttle means 15, which is thus easily accessible from outside the cylinder and can therefore be dismounted and cleaned when required. Passageway 10 preferably has a diameter of from 5 to 15 millimeters, most preferably from about 7 to 10 millimeters, and throttle means 15 preferably has a diameter of from about 2 to 5 millimeters, most preferably from about 3 to 4 millimeters. Having thus described the present invention, it will be specifically defined by the following claims.

It is claimed:

1. Apparatus for drying web materials comprising a cylindrical drum including a tubular jacket and a pair of end walls, means for supplying steam under pressure to the interior of said drum, condensate removal means for removing condensed steam formed within said drum, said condensate removal means comprising passage means extending axially within a portion of said tubular jacket and through one of said end walls, so that said condensate is removed from said drum at a point on the outer periphery of said drum formed by said tubular jacket, condensate collection means communicating with said passage means, said condensate collection means comprising groove means extending circumferentially about the inner surface of said tubular jacket for collecting said condensed steam formed within said drum and supplying said condensed steam to said passage means, throttle means communicating with said passage means exterior to said end wall, said throttle means being mounted on said drum at said outer periphery thereof, vacuum condensing means for condensing steam carried by said condensate, said condensing being carried out under reduced pressure, and discharge conduit means connecting said throttle means to said vacuum condensing means, said throttle means adapted to provide a pressure drop between said passage means and said discharge conduit so that the amount of steam carried by said condensate is limited to an amount of less than about 5 weight percent.

2. The apparatus of claim 1 including a plurality of said passage means.

3. The apparatus of claim 2 including between about 2 and 4 such passage means.

4. The apparatus of claim 1 wherein said discharge conduit means includes a condensate removal conduit coaxial with said drum and communicating with said vacuum condensing means, and radial discharge conduit connecting said throttle means to said condensate removal conduit.

5. The apparatus of claim 4 wherein said radial discharge conduit is connected to said condensate removal conduit by means of an annular coupling so that said radial discharge conduit can rotate about said condensate removal conduit with the rotation of said drum.

6. The apparatus of claim 1 wherein said passage means has a diameter of between about 5 and 15 millimeters and said throttle means has a diameter of between about 2 and 5 millimeters.

* * * * *